US006955122B2

(12) United States Patent
Seiler et al.

(10) Patent No.: US 6,955,122 B2
(45) **Date of Patent: *Oct. 18, 2005**

(54) CROP MARK SPLITTING

(75) Inventors: Thomas Seiler, Thun (CH); Daniel Burri, Konolfingen (CH); Martin Fröhlich, Liebefeld (CH)

(73) Assignee: Maschinenfabrik WIFAG, Bern (CH)

( * ) Notice: Subject to any disclaimer, the term of this patent is extended or adjusted under 35 U.S.C. 154(b) by 0 days.

This patent is subject to a terminal disclaimer.

(21) Appl. No.: 10/629,070

(22) Filed: Jul. 28, 2003

(65) Prior Publication Data

US 2004/0028448 A1 Feb. 12, 2004

(30) Foreign Application Priority Data

Aug. 9, 2002 (DE) ..... 102 36 658

(51) Int. Cl.[7] ..... B41J 11/66; B41J 15/24

(52) U.S. Cl. ..... 101/226; 101/224; 101/485; 101/227; 83/39

(58) Field of Search ..... 101/219, 220, 101/224, 228, 485, 226, 227; 226/40, 42; 83/29, 39, 44

(56) References Cited

U.S. PATENT DOCUMENTS

| | | | | |
|---|---|---|---|---|
| 2,214,593 | A * | 9/1940 | Pittaluga et al. | 83/29 |
| 4,896,605 | A | 1/1990 | Schröder | |
| 5,119,725 | A * | 6/1992 | Okamura | 101/226 |
| 5,123,316 | A * | 6/1992 | Niedermaier et al. | 83/29 |
| 5,289,770 | A * | 3/1994 | Hern | 101/226 |
| 5,483,893 | A | 1/1996 | Isaac et al. | |
| 6,321,650 | B1 * | 11/2001 | Ogawa et al. | 101/227 |
| 6,748,857 | B2 * | 6/2004 | Seiler et al. | 101/226 |
| 2003/0084765 | A1 * | 5/2003 | Elkotbi et al. | 83/13 |

FOREIGN PATENT DOCUMENTS

| | | |
|---|---|---|
| DE | 35 15 626 A1 | 10/1985 |
| DE | 89 15 642.0 | 3/1991 |

* cited by examiner

*Primary Examiner*—Leslie J. Evanisko
(74) *Attorney, Agent, or Firm*—McGlew and Tuttle, P.C.

(57) ABSTRACT

A process and device are provided for setting the crop mark for and/or in a print production, in which prints are continuously printed on a web. At least one printing couple for printing on a web is provided. A lengthwise cutting device cuts the web into a first web strand and at least one second web strand. A converging device is provided for converging the first web strand with at least the second web strand and/or at least one other web strand to form a bundle. A cross-cutting device cuts the bundle. A crop mark setting device is provided with at least one deflecting device for each of the web strands of the bundle. The deflecting devices form a deflection axis for the web strand of the bundle, the web strand being associated with it. The deflecting device is mounted movably such that the particular deflection axis formed is adjustable at right angles to an axial direction by a maximum adjusting path length. The maximum adjusting path length of each deflecting device is such that the adjusting path lengths by which the deflection axes must be adjusted for setting the crop mark positions of the web strands, the crop mark positions being related to the cross-cutting, can be split between the deflecting device of all web strands of the bundle.

19 Claims, 4 Drawing Sheets

CROP MARK SPLITTING

FIELD OF THE INVENTION

The present invention pertains to crop mark setting devices in printing presses, in which a web being conveyed endlessly is printed on or preferably a plurality of such webs are printed on. Furthermore, the present invention pertains to a process for setting the crop mark of printed web strands, which are obtained from one or more webs by lengthwise cutting. The printing press is preferably a web-fed printing press, in which the web or the plurality of webs are unwound from a roll continuously. The present invention is used especially preferably in the web-fed rotary printing of large newspaper circulations.

BACKGROUND OF THE INVENTION

In the continuous print production of such printing presses, the web is, or usually a plurality of webs are printed on with at least two prints arranged next to each other. Viewed in the direction of conveying, the web can be printed on one after another with the same print or in a periodic sequence of two or, in principle, also even more different prints. The web is or the plurality of webs are cut lengthwise between the prints arranged next to each other. A plurality of web strands are converged into a bundle corresponding to the running print production and cut crosswise together at right angles to the direction of conveying of the particular bundle in order to obtain the individual printed products, e.g., newspapers or magazines. In general, a plurality of bundles are converged and cut crosswise together in newspaper printing to obtain the printed product. The web strands, which form a bundle each, are converged such that the prints of the web strands of one bundle are centered as accurately as possible between two consecutive cuts following each other in the direction of conveying. The web strands of one bundle are influenced by means of suitable operations to obtain their so-called crop mark, i.e., for centering between the cuts. Relative to the individual web strand, these operations are changes made specifically on the crop mark of the web strand in question in the path length traveled by the web strand between the site of printing and the site of cross cutting. Thus, the position of the crop mark of the strand in question or, briefly, the crop mark of that strand is set by specifically changing the path length.

Crop mark rollers have proved successful for setting the crop mark. The crop mark rollers are wrapped around by a web strand each, usually over 180°. The path of the web strand wrapping around the crop mark roller is lengthened or shortened by an adjusting movement of a crop mark roller at right angles to its longitudinal axis, and the crop mark of the web strand in question is thus set.

Two or three web strands, which are then converged and folded lengthwise, are usually obtained from the web strand by the lengthwise cutting. To make possible the convergence, the web strands are subjected each individually to one or more suitable turning operations. One of the web strands of the web or, in the case of a plurality of printed webs, one web strand from each web, is not subjected to any turning operation, and is delivered in this sense directly to the site of convergence. Such a web strand will hereinafter be called a direct strand. A web strand that is subjected to one or more turning operations will hereinafter be called a turned strand for distinction.

The present invention also pertains especially to printing presses and web guiding processes of the above-described type.

When the crop mark position of the direct strand of a web strand bundle is set in the prior-art printing presses and web-guiding processes for the direct strand of a web strand bundle, these are settings in the running print production for correcting a deviation of the color mark from the cut. The crop mark position is set anew for each turned strand of the bundle by adjusting the web length of the turned strand in question at the beginning of a new print production, or it is set during the running print production in adaptation to changes in the position of the direct strand. The setting of the crop mark position of the direct strand is not affected hereby. The direct strand forms quasi the leading strand, to which all other web strands of the bundle are set.

One problem is the setting of the press to a new print production. The setting is necessary at the time of the start-up of the press or also at the time of a change in the print production with the press running. The number of copies printed with the same press setting tend to decrease, whereas the number of start-up operations and especially the flying change of the print production with the press running increase to the same extent, i.e., the requirements imposed on the flexibility of the press increase. However, it is increasingly important at the same time to reduce spoilage because of the increasing cost pressure.

SUMMARY OF THE INVENTION

One object of the present invention is to reduce the spoilage generated due to the changeover to a new print production, i.e., the number of printed products that cannot be sold, According to the invention it has been recognized that the reduction of the time needed for the setting of the crop mark position of web strands can make a substantial contribution to the reduction of the spoilage. This applies to the flying change from one print production to a new print production with the press continuing to run, and it also applies, in particular, to cases in which a new web leading end is pulled into the printing press for the new print production.

The subject of the present invention is the setting of the crop mark in a new print production, namely, the setting up to the point in time beginning from which all crop mark positions of the web strands of one bundle of web strands of the new printed product are set. The subject of the present invention also includes the setting of the crop mark in a running print production in order to prevent intolerable deviations from occurring in the crop mark position of one or more of the web strands of the bundle after the conclusion of a basic setting in the current print production.

In a process as pertains to by the present invention, prints are continuously printed on a web. The printed-on web or the web yet to be printed on is cut lengthwise into a first web strand and at least one second web strand. If the web is printed on with two or three prints arranged next to each other at right angles to the direction of delivery, as is usual in the web-fed rotary printing of newspaper editions, the web is cut lengthwise correspondingly into two or three web strands between the already printed-on or yet to be printed prints. However, the present invention is not limited to this preferred case of application, i.e., it also pertains, e.g., to a lengthwise cut into more than three web strands.

One bundle of web strands is or a plurality of bundles of web strands are formed in the further course of the process. In particular, the web strands obtained from the web may form the only bundle of web strands or one of the plurality of web strand bundles alone or together with a web strand or with a plurality of web strands of another web or of a plurality of other webs. Some of the web strands obtained from the web may also form a web strand bundle alone or together with one or more web strands of one or more other webs, and this also applies to the remaining other web strands obtained from the web. Corresponding to the formation of the bundle of web strands or of the plurality of web strand bundles, the web strands obtained from the web are converged with one another and/or with other web strands to form the web strand bundle or the plurality of web strand bundles.

The at least one web strand bundle thus obtained is cut crosswise, i.e., it is cut at right angles to the direction of conveying of the web strand bundle between two consecutive prints. The cross cutting may be performed jointly for a plurality of web strand bundles, as is usual, e.g., during the printing of newspaper editions. However, the present invention also pertains to the case in which only a single bundle of web strands is formed and cut crosswise.

To set the crop mark positions of the web strands of the at least one web strand bundle, the path lengths of the web strands are adjusted by changes in the path length in a mutually coordinated manner. The path lengths of the web strands are measured from the site at which the web strand in question is formed, in general, the site of the lengthwise cutting, to the site at which the web strands of the bundle are converged. At least one deflecting means is arranged in the path of the strand between the site at which it is formed and the site at which the strands are converged for each of the web strands of the bundle for the purpose of adjusting the path lengths. The deflecting means form a deflection axis each, around which the associated web strand is deflected. The deflection axes are adjustable by adjusting path lengths. The deflecting means may be, in particular, crop mark rollers or, in principle, even other types of suitable deflecting means.

According to the present invention, the path lengths of the web strands are adjusted or changed, i.e., the adjusting path length of the associated deflecting means or deflection axis that is necessary per web strand is selected such that a largest of the strand path length changes is reduced. Thus, one of the web strands of the bundle is not selected as a leading strand, to the crop mark position of which the crop mark positions of the other web strands are set, but such an adjusting path length is selected for each web strand of the bundle for the associated deflecting means that a greatest of the adjusting path lengths is smaller than it would be if one of the web strands of the bundle were selected as a fixed leading strand for the other web strands of the bundle. Thus, no leading strand is firmly predetermined according to the present invention, but the adjusting path lengths and the changes in the lengths of the strand paths, which arise from the adjusting path lengths, are selected in the direction of minimizing the maximum adjusting path length.

It is assumed that the adjusting path lengths of the deflecting means or deflection axes and the changes in the path lengths of the web strands are correlated such that a greatest adjusting path length by which one of the deflecting means must be adjusted to set the crop mark position of the associated web strand also brings about the greatest change in path length. The term "change in path length" will therefore hereinafter be used with respect to the process according to the present invention, and the term "adjusting path length" will be used with respect to the device according to the present invention. If the correlation defined above is assumed, one of the two terms is a synonym for the other. A single deflecting means of the plurality of deflecting means may have the greatest of the adjusting path lengths for the web strands of the bundle. However, it may also happen that a plurality of the deflecting means are adjusted by the greatest of the adjusting path lengths, and this term is used here to designate the adjusting path length that is the greatest in terms of value regardless of the direction of the adjusting movement.

The adjusting path lengths are especially preferably selected such that a greatest of the adjusting path lengths is minimized. By means of a suitable algorithm, a control and/or regulating means determines individually for each of the web strands of the bundle an adjusting path length with the provision that a greatest adjusting path length obtained from the determination will be minimized. It is also advantageous, although less preferred than the optimal variant, for the adjusting path lengths to be selected "only" in the direction of such a minimization rather than for the minimization of the greatest adjusting path length. If, e.g., the bundle is formed by only two web strands, the adjusting path lengths will be selected to be equal in value and with opposite signs in the optimal embodiment variant, in which the greatest of the adjusting path lengths is minimized. In the case of the minimization, one of the web strands is shortened by the path length change determined, and the other is lengthened by the same change in the path length. In the suboptimal embodiment variant, the path length of one of the web strands, e.g., of the first web strand, is changed to a lesser extent than in the optimal embodiment variant, but it is changed such that the path length change of the other of the web strands that is necessary for obtaining the correct crop mark position of both web strands, the path length change of the turned strand in the case of the assumed example, is shorter than it would be if the path length change were not performed for the first web strand. It may happen in the case of more than two web strands in the bundle that the path length of one or more of these web strands is neither lengthened nor shortened. However, this situation may arise only for certain initial states of the web strands, but in the manner that there is a fixed leading strand from the start for the particular initial state. Depending on the initial state existing before the adjustment, each of the web strands of the bundle may be a web strand whose path length is not changed for the setting of the web strands of the bundle, which is to be performed from the initial state.

According to the present invention, the printing press comprises a deflecting means for each web strand of the bundle, which said deflecting means forms at least one transversely adjustable deflection axis for the web strand in question. The at least one adjustable deflection axis per web strand is adjustable at right angles to itself by a maximum adjusting path length. The maximum adjusting path length is such for each of the transversely adjustable deflection axes that the adjustment paths can be split between the transversely adjustable deflection axes. The maximum adjusting path length of each of the transversely adjustable deflection axes is preferably such that the adjustment paths between these deflection axes can be split in the case of the convergence of all the web strands formed from a single web. The maximum adjusting path lengths of the transversely adjustable deflection axes are especially preferably equal, so that the adjusting path lengths can be split uniformly between the web strands. However, one goal of the present invention is also achieved already if even though the maximum adjusting path lengths are different, but a splitting of the adjusting paths between the deflection axes can nevertheless be performed to an extent relevant for reducing the time needed for the setting. Movability of the transversely adjustable deflection axes is considered to be inventive at least if the maximum adjusting path lengths differ by no more than 50%, i.e., if a smallest of the maximum adjusting path lengths is at least half a greatest of the maximum adjusting path lengths. As far as the unturned direct strand or the plurality of direct strands of a print production is/are concerned, the consequence of the present invention is that the setting of the crop mark position of the direct strand is also performed so as to reduce or at least minimize the greatest web strand, which is to be performed for one or more of the web strands of the bundle of the direct strand in question.

Since the setting member that has to cover the greatest path of adjustment determines the setting time that is needed for setting the crop mark positions of the web strands of the bundle in the case of crop mark setting members moved at equal speed, which are formed by a deflecting means each, the setting time is reduced by the present invention compared with conventional setting processes with a predetermined leading strand. To the extent to which the setting time necessary for setting the crop mark positions is reduced, the spoilage can be reduced as well, assuming that additional settings of the presses, e.g., the setting of the circumferential register of ink-transferring printing cylinders, can also be performed simultaneously within the setting time.

The embodiment of the path minimization, which was called optimal above, is indeed optimal, strictly speaking, only if the setting speeds of the crop mark setting members are equal. However, this does not have be the case. The setting speeds of the crop mark setting members can be preferably varied in order to make it possible to perform the adjustment at an adapted speed as a function of certain operating parameters, e.g., as a function of the velocity of the web, a property of the web material, e.g., the modulus of elasticity and/or the web thickness and/or as a function of the moisture content in the strand in the case of wet printing.

It should, furthermore, be pointed out in this connection that it is even considered to be particularly advantageous not to change the path lengths of the strand at a setting speed equal to that of the crop mark setting members. Thus, the path of the strand of the web strand bundle whose path length is changed by the greatest amount is also changed at the greatest setting speed according to a preferred embodiment. If the change in path length that has the largest value is a shortening in one web strand of the bundle and an increase in length in another web strand of the bundle, the shortening is preferably performed at the greatest setting speed. It is therefore particularly advantageous in such an embodiment of the process for the change in path length that is the greatest change after the reduction or even minimization to be a shortening, because the setting time can be minimized in this case. Therefore, while the changes in path length were considered above only in terms of their value but the sign of the particular change in path length was not taken into account, this applies, strictly speaking, only under the assumption that the changes in path length are carried out at the same setting speeds of the corresponding crop mark setting members.

As far as the device is concerned, the consequence of the above considerations is that the crop mark setting members in the form of the deflecting means are preferably driven at variable setting speeds. The crop mark setting device correspondingly comprises a control means, which may be expanded into a regulating means, which permits such a variation of the setting speed and preferably calculates the optimal setting speed individually for the strands correspondingly based on the stored and selected or set production configuration and controls or regulates the setting members correspondingly.

The deflecting means for a turned strand of the bundle, i.e., a web strand that is turned before the bundle is formed, is preferably arranged in front of the area of the turning bar for this turned strand. If one web strand is or the plurality of web strands that are obtained from one web is/are delivered into the bundle without turning, the deflecting means for such a direct strand is preferably arranged in space in the vicinity of the deflecting means of the turned strand.

The deflecting means for the web strands of the web are arranged in a preferred embodiment of the present invention such that a web that has not yet been cut lengthwise can be pulled in at the same time around the deflecting means, as a result of which the pulling in of the web by the press is considerably facilitated. To facilitate this, no other deflecting means, which are wrapped around only by a single one of the web strands of the web, are arranged between the deflecting means. They are preferably even arranged next to each other in the sense that no other deflecting means for the web are arranged between them whatsoever in the path of the web. Lengthwise cutting is preferably performed during the pulling in of the web only when the web has been pulled in by the crop mark setting device thus formed.

In the embodiment in which two deflecting means are arranged at right angles to the web strands close to one another in space, they are preferably supported on one side of the frame only, while they project with a free end each in the direction of the respective other side of the frame. Due to a relative adjusting movement taking place between the two deflecting means, the two deflecting means can be preferably brought into a position in which they are aligned with one another and preferably form a cylindrical, smooth, uniform surface for the web to be pulled in. If three web strands are formed from one web, the deflecting means for the third strand is likewise arranged in front of the turning bars, and, in particular, the third deflecting means may be arranged next to the other two.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
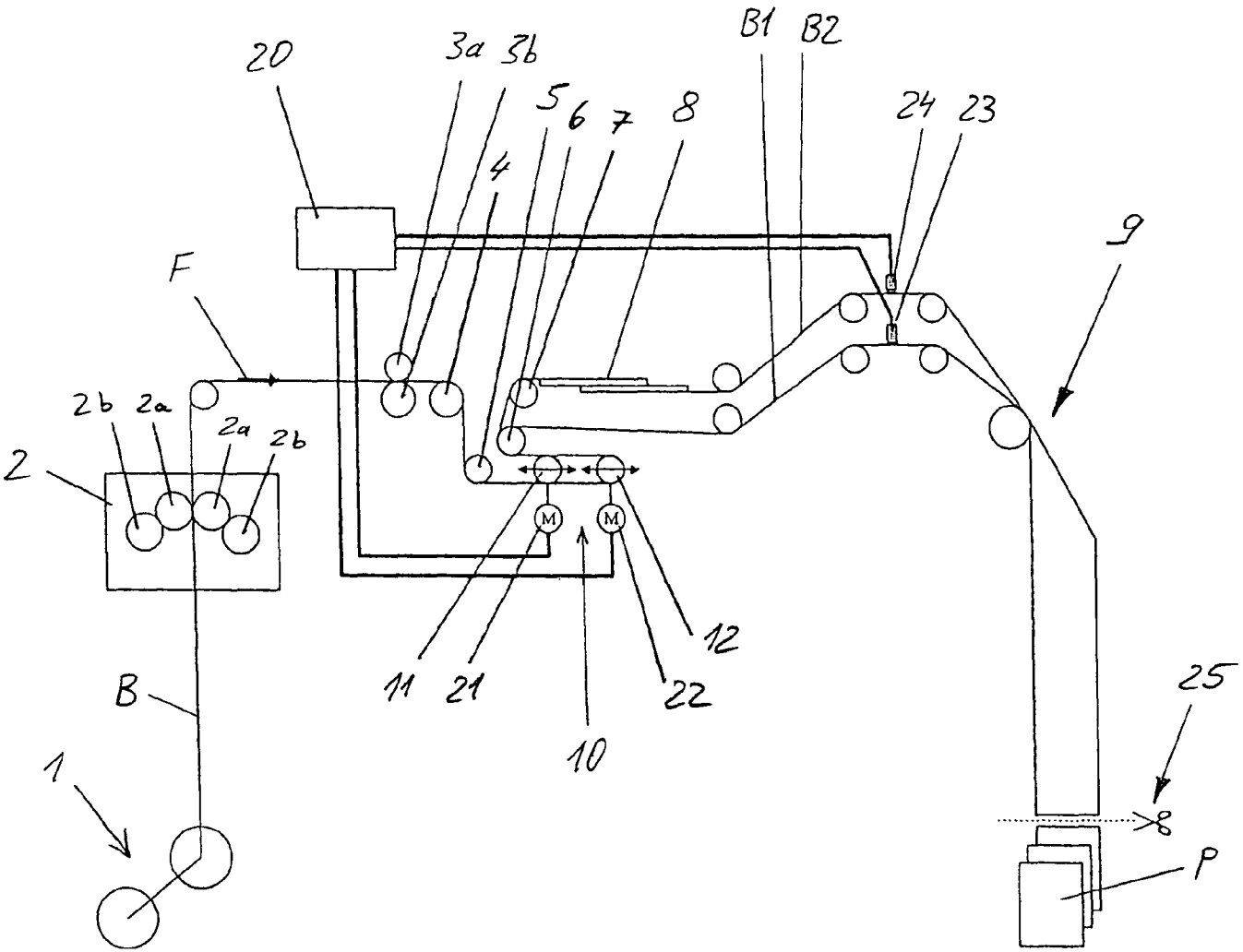
FIG. 1 is a schematic view showing a printing press with a crop mark setting device, which is arranged in front of a turning bar means.

Referring to the drawings in particular, FIG. 1 shows the path of a web B through a web-fed rotary printing press for printing newspapers. The web B is unwound from a roll, which is mounted in a roll changer 1, and is delivered through a printing couple 2 in a direction of conveying F. It is printed on in the printing couple 2 on both sides. The printing couple 2 comprises two rubber blanket cylinders 2*a*, between which a printing gap is formed for the web B passing through. A printing form cylinder 2*b* each is associated with the rubber blanket cylinders 2*a*. The printing form cylinders 2*b* transfer their prints coated with printing ink in the pattern of an image to the rubber blanket cylinders 2*a*, by which they are finally printed on the web B. The rubber blanket cylinders 2*a* are preferably not coupled with one another mechanically, but are driven synchronously by a separate drive motor each, and they drive in turn the associated printing form cylinder 2*b* via a mechanical gear mechanism each. The printing form cylinders 2*b* carry at least two printing forms next to each other in the longitudinal direction of the cylinder on their circumference, and the prints of these printing forms are correspondingly printed on the web B next to each other. A single printing form or, as is usual, two printing forms or, in principle, even more printing forms may be provided on the printing form cylinders 2*b* one after another in the circumferential direction. When viewed in the longitudinal direction of the cylinder, the printing forms have the width of an opened page of the newspaper.

To form the individual printed copies, newspaper copies in the exemplary embodiment, the web B is cut lengthwise between the prints by means of a lengthwise cutting means after the printing. The lengthwise cutting means is formed by a cutting roller 3*a* and a counterroller 3*b*, which are arranged opposite each other on one side of the web B. Two web strands B1 and B2, which will hereinafter be called the first web strand B1 and the second web strand B2, are obtained from the web B by the lengthwise cutting. The web strands B1 and B2 are subsequently delivered via a draw roller 4 to a crop mark setting device 10. The paths of the web strands B1 and B2 separate after running out of the crop mark setting device 10. The first web strand B1 is led from the crop mark setting device 10 to a lengthwise folding means 9, which is preferably designed as a former, only via web guide means without turning or reversing operations. The second web strand B2 runs out of the crop mark setting device 10 and into a turning bar means 8. While passing through the turning bar means 8, the second web strand B2 is turned and/or reversed and subsequently converged with the first web strand B1 to form a web strand bundle, which comprises only the two web strands B1 and B2 in the exemplary embodiment. However, it is also possible that one or more other web strands of another web or a plurality of other webs are united with the two web strands B1 and B2 before the lengthwise folding means 9. The web strands B1 and B2 located one on top of another in the bundle are folded lengthwise together while running through the lengthwise folding means 9 and are delivered into a cross-cutting means 25. The cross-cutting means 25 may be especially a cutting cylinder of a folder, as is usually used in the web-fed rotary printing of newspapers. The lengthwise folded and cross-cut individual copies of printed products are designated by P. If they are newspaper copies, as in the exemplary embodiment, they are also cross-folded after the cross-cutting in order to finally obtain the newspaper copies. Even though a web strand bundle comprising the web strands B1 and B2 may already form a printed product P after the cross-cutting, for example, additional web strand bundles formed in the same manner are usually united with the web strand bundle B1/B2, and the plurality of web strand bundles are subsequently crosscut in the cross-cutting means 25.

It is ensured by means of the crop mark setting device 10 that the prints of the web strands B1 and B2 will always come to lie between consecutive cuts of the cross-cutting means 25 and are properly centered between the cuts in the practical operation, i.e., they are positioned with sufficient accuracy in relation to the common crop mark. The different paths of the web strands B1 and B2 from the printing to the site of convergence in the lengthwise folding means 9 and possibly an offset of the printing forms located next to each other on the printing form cylinders in the circumferential direction, i.e., an offset of the prints of the first web strand B1 in relation to the prints of the second web strand B2 in the direction of conveying F, must be compensated for this positioning. Such an offset is common in newspaper printing to reduce balance errors due to channel beats of the ink-transferring cylinders of the printing couples. Furthermore, the length of the prints measured in the direction of conveying F, which is represented in a printing press control ultimately by the circumference of the printing form cylinders, should be taken into account. If differences in length that are relevant for the crop mark position develop to an extent that is relevant for practice due to the different paths of the web strands B1 and B2 because of differences in the longitudinal elongations, these differences in length, which affect the crop mark, are also compensated by means of the crop mark setting device 10. The different influential factors cause the position of the prints of the web strands B1 and B2 to deviate from the correct crop mark position. These deviations will hereinafter be called position differences for the sake of simplicity.

The crop mark setting device 10 comprises two deflecting means, namely, a first deflecting means 11 and a second deflecting means 12, as well as a deflecting roller 5 at the intake to the deflecting means 11 and 12 and another deflecting roller 6 at the outlet from the deflecting means 11 and 12.

The two web strands B1 and B2 wrap around the intake deflecting roller 5 as well as the outlet deflecting roller 6 together, i.e., in parallel next to each other. The web strands separate at the outlet deflecting roller 6. The first web strand B1 is passed through the area of the turning bar means 8 without turning or reversing operations. The first web strand B1 may therefore also be called a direct strand. The second web strand B2 runs from the outlet deflecting roller 6 via an intake roller 7 into a turning bar plane of the turning bar means 8 and is turned and/or reversed there by a corresponding guiding of the web and is subsequently converged with the first web strand B1. The second web strand B2 may therefore also be called a turned or reversed strand.

While passing through the crop mark setting device 10, the first web strand B1 is guided over the first deflecting means 11 and the second web strand B2 over the second deflecting means 12 and deflected around the deflection axis formed by the respective deflecting means 11 or 12. The intake deflecting roller 5 and the outlet deflecting roller 6 are arranged in relation to the deflecting means 11 and 12 such that the first web strand B1 wraps around the first deflecting means 11 and the second web strand B2 around the second deflecting means 12 by 180° each, so that the web strands B1 and B2 run in parallel onto and off from their deflecting means 11 or 12. The two deflecting rollers 5 and 6 are stationarily but rotatably mounted roller bodies. The deflecting means 11 and 12 are likewise formed by a rotatably mounted roller body each. Both deflecting means 11 and 12 are mounted movably to and fro in a common plane of movement linearly along a common axis of movement at right angles to their axes of rotation, which also form the deflection axes at the same time. The direction of mobility (axis of movement) is parallel to the web strands B1 and B2, which run from the intake deflection roller 5 to the deflecting means 11 and 12 and from the deflecting means 11 and 12 to the outlet deflection roller 6. The direction of the alternating mobility is indicated by a double arrow each at the deflecting means 11 and 12.

The arrangement of the crop mark setting device 10 in the path of the second web strand B2, i.e., the turned strand, in front of the turning bar means 8 has the advantage that the deflecting means 12 of this strand, which affects the crop mark position, can be made in the width of the second web strand B2 and does not have to have twice the width of the web strand, as in the case of the conventional arrangement after the turning bar means 8. Furthermore, the setting of the crop mark for the second web strand B2 before the turning and/or reversing operation is performed makes possible the mechanical intake of the leading end of a new web up to behind the crop mark setting device 10 for the second web strand B2.

Figure 2:
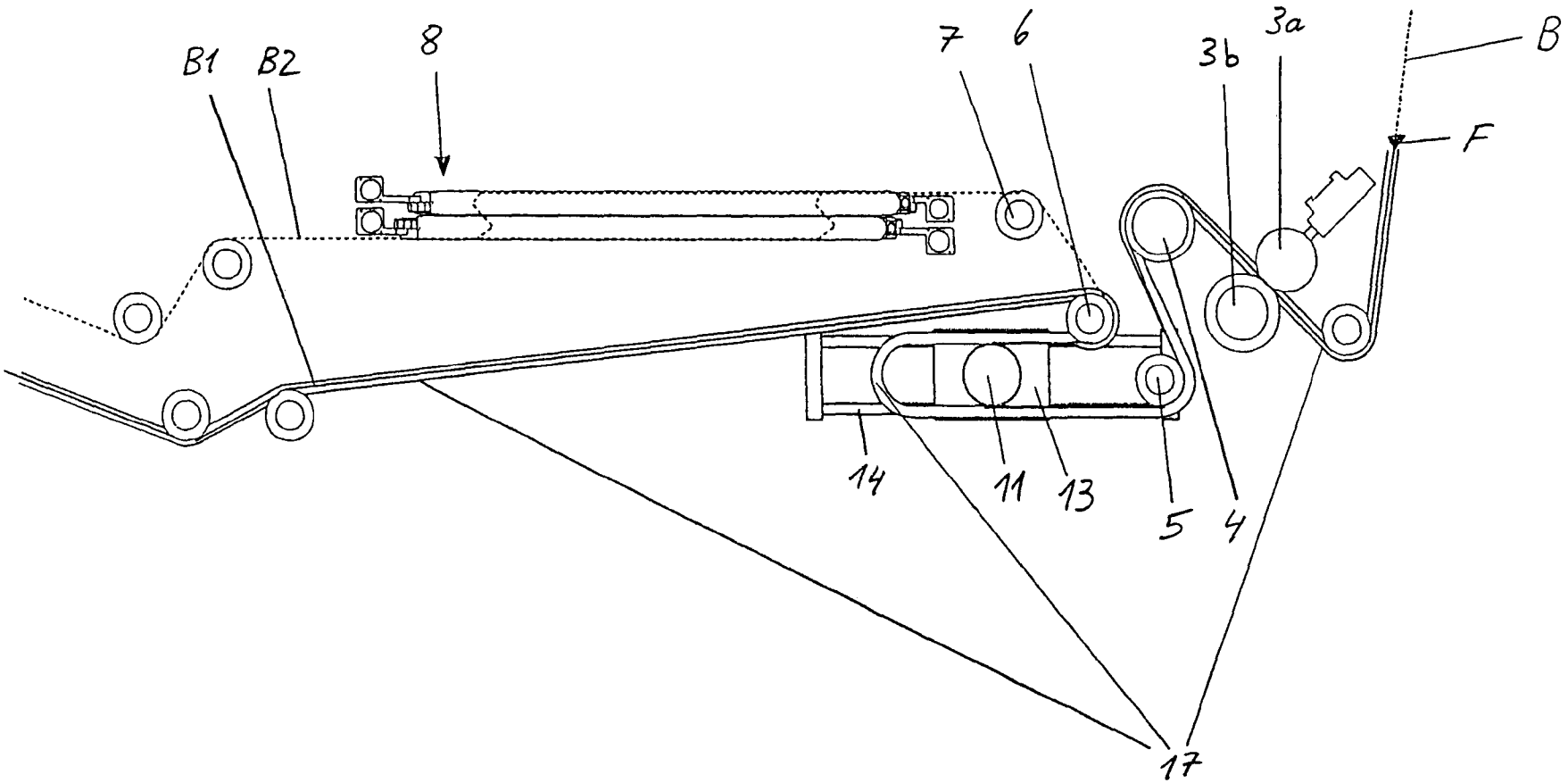
FIG. 2 is a side view showing a view of the crop mark setting device which is in a first state.

FIG. 2 shows a guideway 17 of a mechanical and in this sense automatic web intake system. The guideway 17 is formed by guide rails, which are arranged on one side next to the web guide means and are used to guide a driven intake means. In particular, the guideway 17 runs around the deflecting means 11 and 12 of the crop mark setting device 10. The guideway 17 is run, furthermore, around the intake deflecting roller 5 and the outlet deflecting roller 6 and farther along the path of the first web strand B1. When a new web B is being pulled in, which is indicated in FIG. 2, the leading end of this web is led through between the cutting roller 3*a* and the counterroller 3*b* along the guideway 17, around the draw roller 4, the intake deflecting roller 5, to and around the two deflecting means 11 and 12, and then back again from there and is pulled around the outlet deflecting roller 6 and farther along the path of the first web strand B1.

Figure 3:
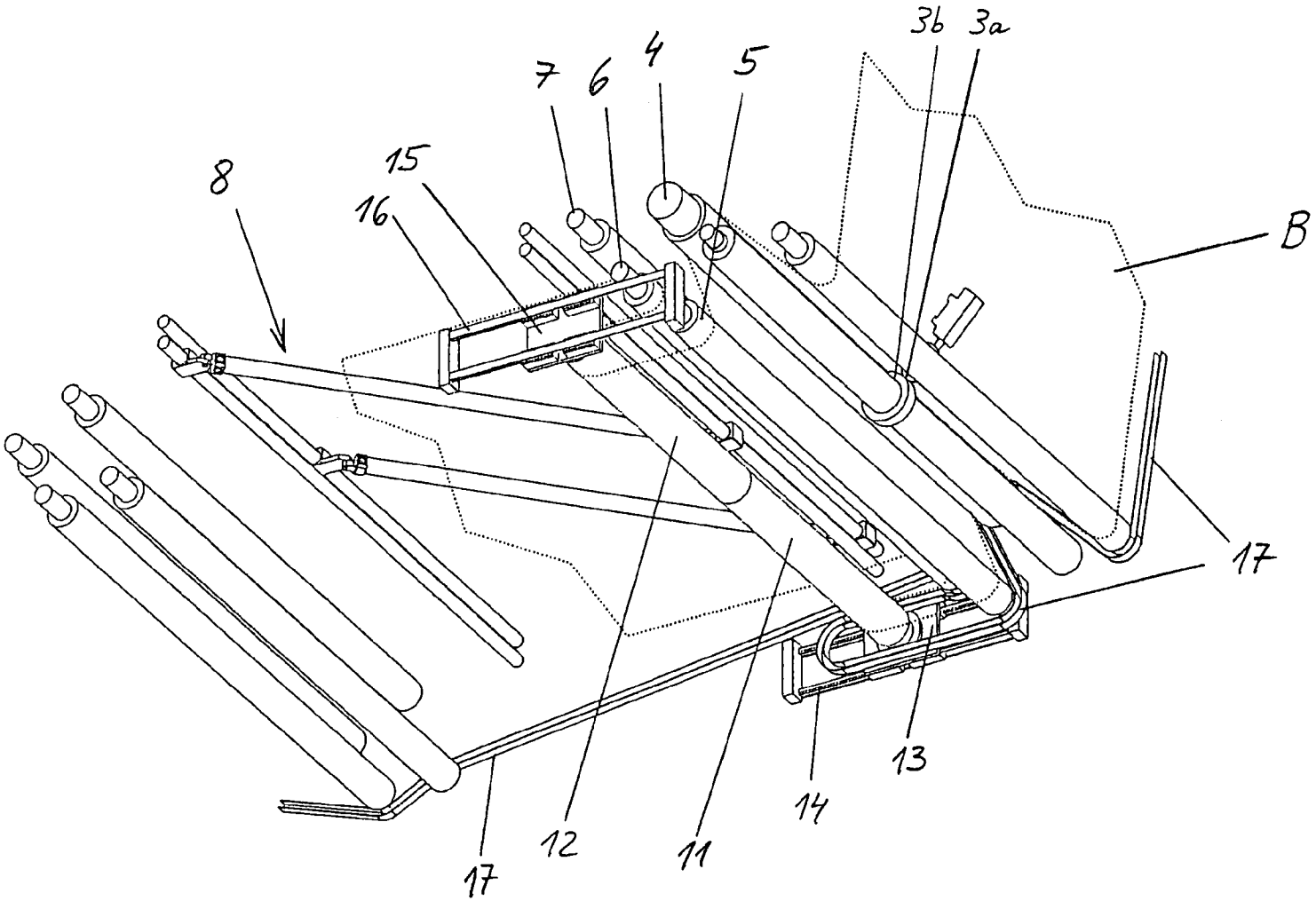
FIG. 3 is a perspective view showing the crop mark setting device which is in the first state.

FIG. 3 shows the web B in this state immediately after the mechanical pulling in over the complete path of the later first web strand B1. The rollers 3*a* and 3*b* of the lengthwise cutting means are moved toward each other in this state and the web B is cut lengthwise between the later prints. After a web leading end was formed for the second web strand B2, e.g., by tearing off manually after the lengthwise cutting, the leading end of the second web strand B2 is pulled in manually from the outlet deflecting roller 6 over the intake roller 7 for the turning bar means 8, through the turning bar means 8 and over the downstream web guide means. The manual pulling in via a deflecting means of a crop mark setting device is eliminated, which offers advantages in terms of time and contributes to a reduction of pulling-in errors.

Figure 4:
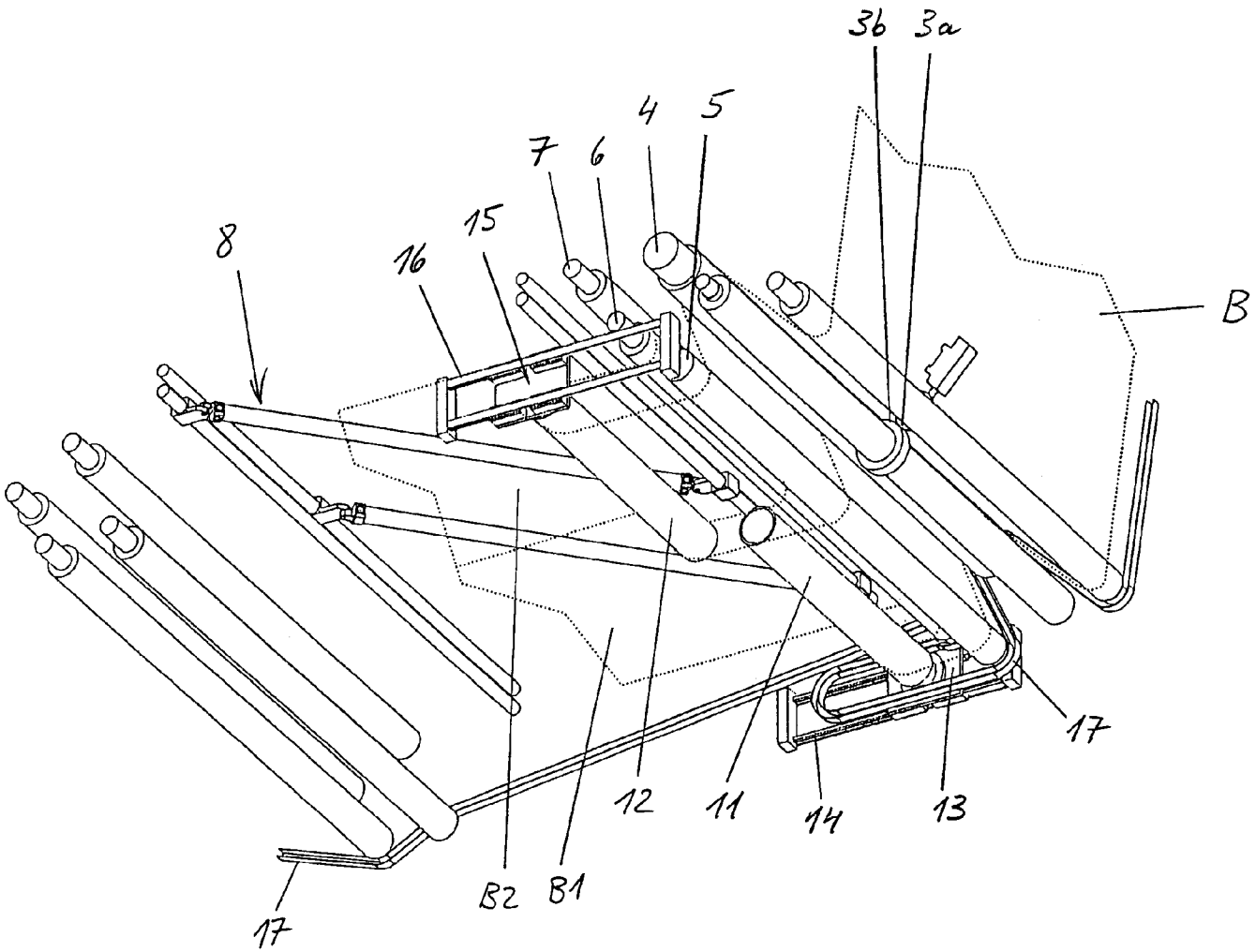
FIG. 4 is a perspective view of the crop mark setting device which is in a second state.

FIG. 4 shows the web B after the lengthwise cutting and before the formation of a leading end for the second web strand B2.

FIG. 1 also shows a control and regulating means, which is used to control and regulate the adjusting movements of the two deflecting means 11 and 12. The control and regulating means comprises two sensors 23 and 24, a control and regulating member 20 and two motor-driven final control elements 21 and 22. The sensor 23 detects the position of the print on the first web strand B1 running through under it, and the sensor 24 detects the position of the prints on the second web strand B2 running through under it. The position signals of the sensors 23 and 24 are sent to the control and regulating member 20. The control and regulating member 20 calculates the two sensor signals by means of a suitable algorithm and forms from them the setting signals for the final control elements 21 and 22 by comparison with desired input signals. The final control element 21 is coupled with the first deflecting means 11 and the final control element 22 with the second deflecting means 12. The final control elements 21 and 22 act on the deflecting means 11 and 12 corresponding to the setting signals formed by the control and regulating member 22, i.e., they bring about the adjusting movement of the deflecting means 11 and 12 along their common axis of movement of these deflecting means. During the running printing operation, the control and regulating member 20 forms a regulating unit with the sensors 23 and 24 and with the final control elements 21 and 22 for setting the correct crop mark position for each of the web strands B1 and B2. These members form a control and regulating unit until a basic setting is obtained especially when a new print production is started.

FIGS. 3 and 4 show the crop mark setting device 10 and its immediate environment in the same view in a three-dimensional view, but in two different states of the crop mark setting device 10. The states differ by the positions assumed by the deflecting means 11 and 12 in relation to one another. The design of the two deflecting means 11 and 12 as regular cylindrical, smooth roller bodies each, having the width of the strand, can be recognized, in particular. Due to the design as roller bodies having the width of the strand, the deflecting means 11 and 12 can be arranged in a narrow space next to one another. The deflecting means 11 and 12 are arranged and mounted movably such that they have the same height in relation to the direction of conveying F of the web B, as is shown in FIG. 3, and they even form a smooth, uniform roller body in an axially continuous manner, which is especially preferred. The roller body formed by the two deflecting means 11 and 12 together forms a simple deflecting roller during the pulling in of a new web. The inevitable gap between the free ends of the roller bodies is kept so narrow within the tolerances that it can be ignored for the pulling in of the web B. The roller body is uniform in this sense. The deflection axes formed by the deflecting means 11 and 12 are aligned in the first state. In the first state, the deflecting means 11 and 12 assume their respective initial basic positions in relation to one another, in which a web with a free leading end is pulled in.

The deflecting means 11 and 12 can be moved away from each other in opposite directions from the first state by means of the final control elements 21 and 22, e.g., into the second state shown in FIG. 4, in which their deflection axes are offset at a maximum distance in parallel to one another. In the second state shown, the deflecting means 11 and 12 assume positions in which the path of the first web strand B1 has a minimum length and the path of the second web strand B2 has a maximum web length. The deflecting means 11 and 12 can also be moved from the position that they assume in the first state into their two other extreme positions if this is required by the crop mark regulation. Intermediate states can, of course, be set as well, preferably continuously.

To obtain the adjusting movements, the deflecting means 11 and 12 are mounted in a linearly guided manner at their outer axial ends facing away from each other on one side each of a frame along the axis of movement. The side of the frame on which the first deflecting means 11 is mounted is designated by 14, and the side of the frame on which the second deflecting means 12 is mounted is designated by 16. The frame sides 14 and 16 form a guideway each, which is parallel to the axis of movement. The deflecting means 11 and 12 are mounted rotatably on one of two carriages 13 and 15, which is guided linearly by the guideway formed by its frame side 14 or 16. The two carriages 13 and 15 ensure the rigid mounting of the deflecting means 11 and 12 on their respective frame side 14 or 16. The deflection axes formed by the deflecting means 11 and 12 form a right angle each with the guideways formed by the frame sides 14 and 16.

The adjustability of the deflecting means 11 and 12 is such due to their mounting and the coupling with the final control elements 21 and 22 that the adjusting movements necessary for positioning the crop marks of the two web strands B1 and B2 can be split between the deflecting means 11 and 12, preferably at least essentially in half, and especially preferably exactly in half. The maximum lengths of the adjusting paths of the deflecting means 11 and 12 are correspondingly equal. Due to the deflecting means 11 and 12 being advantageously arranged directly next to each other, the adjusting paths are, in fact, equal, i.e., the deflection axis formed by the first deflecting means 11 and the deflection axis formed by the second deflecting means 12 can be moved to and fro between the two equal outer extreme positions. The two deflecting means 11 and 12 are therefore equivalent in the ideal case described.

The adjustability of the first deflecting means 11 opens up new possibilities for setting the crop marks of the direct strand and of the turned strand, i.e., for controlling and/or regulating the web strands B1 and B2.

When setting the crop marks, the differences in the positions of the respective prints, which difference exists between the direct strand and the turned strand, is conventionally compensated solely by changing the length of the web strand of the turned strand. By contrast, the positioning of the print in good register on the direct strand is ensured by the printing couple. An adjustment of the path length of the direct strand is performed at best to a limited extent, and this adjustment is not performed in reference to the crop mark of the other web strand or the crop marks of the plurality of other web strands of the bundle, but only in reference to the position of the cut in the cross-cutting means. The path length of a strand is defined in the sense of the present invention as the path length of the strand in question beginning from its formation, i.e., the site of lengthwise cutting in the strands B1 and B2, to the convergence. In the prior-art setting processes, the direct strand is the leading strand of the bundle, to which the other web strands of the bundle are adjusted. In the case of the other web strand or the plurality of other web strands of the bundle, this manner of crop mark setting requires long adjusting paths for their deflecting means, which are used for the setting. The adjusting paths are typically on the order of magnitude of 200 mm to 400 mm. On the other hand, the speed of the adjusting movement is limited. Thus, experience has shown that a linear register, and each of the deflecting means 11 and 12 is such a linear register, may lengthen the path of the strand by a maximum of 1 mm per meter of web. If, e.g., an adjusting path, i.e., register path of 300 mm is required to change the print production over to another print production with the print production running without interruption, at least 300 m of web run through the printing press before the crop mark is readjusted. If the printed products are newspaper copies, whose length shall be assumed to be 1 m to simplify the estimate, the new crop mark will have been set only after 300 printed copies. The first 300 printed copies of the new production are spoilage.

However, the adjusting movement necessary for setting the crop mark can be now split between two web strands B1 and B2 due to the special adjustability of the deflecting means 11 for the direct, first web strand B1. More generally, the adjusting path for the turned strand of the web strand bundle is reduced by part of it, preferably half of the adjusting path for the turned strand, being taken over by the crop mark setting member for the direct strand, the first deflecting means 11 in the exemplary embodiment. The total adjusting path necessary is preferably split uniformly. If the direct strand is converged with a plurality of web strands to form a bundle, the adjusting paths are preferably split as uniformly as possible among the web strands to be converged. The adjustment is advantageously performed under the optimization strategy that the setting time becomes minimal under the assumption of equal adjustment speeds for the setting of the crop marks.

Precisely this concept of setting is embodied by means of the crop mark setting device 10 according to the present invention. Instead of carrying out the entire position difference of the crop mark of the second web strand B2 by the adjusting movement of the second deflecting means 12, part, preferably half, of the adjusting movement is transferred to the first deflecting means 11. If the deflecting means 12 of the second web strand B2 had to be adjusted by 300 mm along its axis of movement in case of the exclusive setting of the crop mark of the second web strand B2 in order to compensate a position difference of 600 mm between the web strands B1 and B2, an adjusting path of only 150 mm is needed in case of the 50:50 split for the deflecting means 11 and 12 from their respective starting positions which they assumed before the adjustment. The path of the first web strand B1 is made longer by the same amount as the path of the second web strand B2 is shortened. Depending on the starting positions from which the deflecting means 11 and 12 are adjusted and the path length changes that shall be made, setting in the reverse direction, i.e., shortening the path of the first web strand B1 and lengthening the path of the second web strand B2, may sometimes also be advantageous. The reduction of the length of the adjusting path of the second deflecting means 12 is also especially advantageous at the time of a changeover from one printed product to another with the print production running, because spoilage can be considerably reduced.

However, the new crop mark setting may have the consequence that the first web strand B1 is not in register with the cut because of the change in its path length, even though the color mark or the color marks were in register with the cut before the adjustment. The direct, first web strand B1 is brought into register with the cut in another way, e.g., by means of a compensator roller for web B or preferably by a coordinated adjustment of the circumferential registers of the cylinders that transfer the ink onto the web B. The cross-cutting means may also be adjusted in agreement with the path length changes of the web strands B1 and B2. Both the circumferential registers of the ink-transferring cylinders and the cross-cutting means may be adjusted in a coordinated manner if necessary. This part of the registering is performed jointly with all web strands B1 and B2 of the same web B and with all web strands of the bundle. Registering web by web and strand by strand are correspondingly coordinated with each other for the cut per bundle and preferably performed simultaneously. What was said on the basis of the exemplary embodiment regarding the registering by means of these additional crop mark setting members also applies to the general case of the present invention, in which the web strand bundle being considered also contains one or several additional web strands besides the web strands B1 and B2 or only one of the web strands B1 and B2.

The present invention is already advantageous even for a printing press for one-sided, single-color printing or for two-sided printing in a single printing gap of a printing couple, as is described for the purpose of explaining a printing couple on the basis of FIG. 1. The printing press may have a plurality of printing couples of this type, i.e., rubber-on-rubber printing couples, and/or even of another type, e.g., satellite printing couples, and the different types of printing couples are arranged and operated such that the web B is printed on in multiple colors or a plurality of webs B are printed on in a single color or in multiple colors. Each of the cylinders touching the web and printing ink on the web is preferably driven by a separate motor each, and the necessary synchronization of the cylinders in question is performed by means of signals, e.g., electronically, rather than mechanically. This manner of forming the print positions is advantageous in respect to the adjustment of the color mark, with which the change in the position of the direct strand B1 in relation to the cut is preferably compensated. One crop mark setting device 10 according to the present invention is preferably arranged for each of the webs of a plurality of webs and it preferably also has the additional features of this setting device.

If, e.g., the web strands B1 and B2 are converged with a third web strand B3 to form a bundle, and if the position difference of the second web strand B2 from the cut were, e.g., 300 mm and the position difference of the third web strand B3 from the cut were, e.g., 400 mm, while the first web strand B1 assumes, e.g., a correct crop mark position at the time of the measurement, i.e., the position difference is "zero," the change in the path length of the strand that would be necessary in the case of the conventional setting process would be 300 mm for the second web strand B2 and 400 mm for the third web strand B3, whereas no compensation would be necessary for the first web strand B1, and the adjusting path of the first deflecting means 11 would therefore be "zero." The greatest change in the path length of the strand and the greatest adjusting path length of the deflecting means in question would be necessary for the third web strand B3. The deflecting means of this web strand would have to be moved by the greatest adjusting path length from its initial position. The total setting time necessary would correspond to the time that would be needed to move the deflecting means for the third web strand B3 from the initial position it assumed before the setting by the adjusting path length necessary for changing the path length of the web by 400 mm.

Assuming that the paths of both web strands B2 and B3 would have to be shortened in this example, the path length of the first web strand B1 is made longer by 200 mm in the most optimal embodiment variant of the setting process according to the present invention, in which the greatest of the adjusting path lengths is minimized. The path of the second web strand B2 correspondingly needs to be shortened by only 100 mm rather than by 300 mm. However, the greatest of the web path length changes, namely, that for the third web strand B3, is markedly reduced, in particular. The shortening of the path length that is still necessary for the third web strand B3 is no longer 400 mm but only 200 mm. This corresponds in the example to the minimum of the path length change for the third web strand B3. In the embodiment of the deflecting means described on the basis of the exemplary embodiment, the greatest of the adjusting path lengths by which one of the deflecting means must be adjusted is 100 mm. The first deflecting means 11 must be adjusted in the example by 100 mm for lengthening the path of the strand in question, and the deflecting means for the third web strand B3 must be adjusted likewise by 100 mm for shortening the path of the strand in question by an equal amount.

The greatest of the web path length changes and the greatest of the adjusting path lengths were minimized in the above example. However, the present invention is not limited to such an absolute minimization, but it also covers suboptimal embodiment variants of the setting process. In reference to the example, lengthening the path of the first web strand B1 by only, e.g., 150 mm and correspondingly shortening the path of the second web strand B2 by 150 mm and the path of the third web strand B3 by 250 mm to bring all three web strands B1, B2 and B3 to the crop mark position would thus still be covered by the present invention as well.

The third web strand B3 in the example explained above may be a web strand that is obtained by lengthwise cutting from the same web B as the first web strand B1 and the second web strand B2. However, the third web strand B3 does not have to have been obtained from the same web B as the other two web strands B1 and B2, but it may also have been obtained from another web by lengthwise cutting. It may, in principle, even have been unwound from a roll directly in the width of a web strand. Finally, the web strands B1 and B2 obtained from the same web B do not have to be converged, either, but each of the web strands B1 and B2 may also be converged only with one web strand or with a plurality of web strands of other printed webs to form a web strand bundle each. The setting process according to the present invention and the arrangement according to the present invention of individual or all crop mark setting members for the web strands before the turning bars and also the arrangement of the crop mark setting members provided for each web for their strands in mutually closely spaced locations in space are advantageous in many different web guiding patterns which lead to the formation of web strand bundles.

While a specific embodiment of the invention has been shown and described in detail to illustrate the application of the principles of the invention, it will be understood that the invention may be embodied otherwise without departing from such principles.

What is claimed is:

1. A process for setting a crop mark for and/or in a print production, in which prints are continuously printed on a web; the process comprising:

cutting the web lengthwise into a first web strand and at least one second web strand;

converging the first web strand with at least the second web strand and/or at least one other web strand to form a web strand bundle;

cross-cutting the web strand bundle between prints following each other in the direction of conveying;

adjusting lengths of paths of the web strands of the bundle, before the convergence, by path length changes that are selected to be such that crop mark positions of the web strands related to the cross cutting are set; and said step of adjusting lengths of the paths includes selecting the path length change for the first web strand to be such that a greatest of the path length changes is smaller than it would be if the path length of the first web strand were not adjusted.

2. The process in accordance with claim 1, wherein the path length change of the first web strand is selected to be such that the greatest of the path length changes becomes minimal.

3. The process in accordance with claim 1, wherein the path length change is selected for each of the web strands of the bundle to reduce and/or minimize the greatest of the path length changes.

4. The process in accordance with claim 1, wherein at least one of the web strands of the bundle is turned and/or reversed before the convergence and the path length change is performed for the turned and/or reversed web strand before the turning and/or reversal.

5. The process in accordance with claim 1, wherein the first web strand is converged with the second web strand and/or with the at least one other web strand of the bundle directly, without turning, and cross-cut.

6. The process in accordance with claim 1, wherein a color mark of a printing cylinder, which transfers ink for a print to be printed on the web in the pattern of an image, is set in such a way that the setting is coordinated with the change in the path length of the first web strand in order to obtain the crop mark position of the web strand that is related to the cross cutting.

7. The process in accordance with claim 1, further comprising:

providing at least one printing couple for printing on the web;

providing a lengthwise cutting means for said lengthwise cutting of the web into the first web strand and the at least one second web strand;

providing converging means for said converging of the first web strand with the at least second web strand and/or at least one other strand to form a bundle;

providing a cross-cutting means for said cross-cutting of the bundle; and providing a crop mark setting device comprising at least one deflecting means for each of the web strands of the bundle, said deflecting means forming a deflection axis for the web strand of the bundle, wherein said deflecting means is mounted movably such that the particular deflection axis formed is adjustable at right angles to an axial direction by a maximum adjusting path length, wherein the maximum adjusting path length of each of said deflecting means is such that the adjusting path lengths by which the deflection axes must be adjusted for setting the crop mark positions of the web strands, said crop mark positions being related to the cross-cutting, can be split between said deflecting means of all web strands of the bundle.

8. The process in accordance with claim 7, wherein each of said deflecting means is adjustable by a maximum adjusting path length, which is at least half the maximum adjusting path length of each other of said deflecting means.

9. The process in accordance with claim 7, wherein the maximum adjusting path lengths of said deflecting means are at least essentially equal.

10. The process in accordance with claim 7, wherein the first web strand is a direct strand, which is converged without turning with at least the second web strand and/or the at least one other web strand to form the web strand bundle.

11. The process in accordance with claim 7, wherein said converging means comprises a turning bar means for the second web strand or the at least one other web strand of the bundle, and said deflecting means for the second web strand or the at least one other web strand of the bundle is arranged in the path of the second web strand or of the at least one other web strand of the bundle in front of the turning bar means.

12. The process in accordance with claim 7, wherein the converging means comprises a turning bar means for the second web strand and said deflecting means for the first web strand and said deflecting means for the second web strand are arranged on a common part of the path of the web strands in front of the turning bar means.

13. The process in accordance with claim 12, wherein said deflecting means for the first web strand and said deflecting means for the second web strand are arranged such that the web can be pulled in during the pulling in of the web around both said deflecting means before the web is cut lengthwise.

14. The process in accordance with claim 7, wherein said deflecting means for the first web strand and said deflecting means for the second web strand are arranged such that the path of the first web strand separates from the path of the second web strand only behind the two deflecting means.

15. The process in accordance with claim 7, wherein said deflecting means for the first web strand and said deflecting means for the second web strand are arranged such that the web can be guided simultaneously around both said deflecting means during the pulling in of the web.

16. A process for adjusting a crop mark on a web, the process comprising the steps of:

providing the web with a plurality of cropmarks;

cutting the web lengthwise into a first web strand and a second web strand;

moving said first and said second web strands along separate first and second paths respectively;

converging said first web strand with said second web strand to form a web strand bundle;

cross-cutting said web strand bundle after said converging based on said cropmarks;

adjusting lengths of said paths of said web strands before said converging to adjust a position of said cropmarks at said converging, said adjusting including adjusting said length of both said first and second paths between said cutting and said converging with a greatest of the path length changes being smaller than a path length change required, to provide the same adjustment of position of said cropmarks at said converging, if the path length of one of the web strands were not adjusted.

17. A process in accordance with claim 16, wherein:

a measuring of a deviation of said cropmarks is preformed;

said adjusting of said length of said first and second paths is performed to have individual changes in both of said lengths be less than said deviation of said cropmarks.

18. A process in accordance with claim 17, wherein:

said adjusting of said length of said first and second paths is performed to minimize length changes in said first and second paths.

19. A process for setting a crop mark for a print production the process comprising:

continuously printing prints on a web;

cutting the web lengthwise into a first web strand and at least one second web strand;

converging the first web strand with at least the second web strand and/or at least one other web strand to form a web strand bundle;

cross-cutting the web strand bundle between prints following each other in the direction of conveying;

a measuring of a deviation of the cropmarks between web strands before convergence;

adjusting lengths of paths of the web strands of the bundle, before the convergence, by web strand path length changes that are selected to be such that crop mark positions of the web strands are set related to the cross cutting by selecting individual path length changes that are each less than said deviation of the cropmarks.

* * * * *